US006907863B2

(12) United States Patent
Henmi

(10) Patent No.: US 6,907,863 B2
(45) Date of Patent: Jun. 21, 2005

(54) FUEL DISTRIBUTOR

(75) Inventor: Kenichi Henmi, Koga (JP)

(73) Assignee: Sanoh Kogyo Kabushiki Kaisha, Ibaraki-ken (JP)

( * ) Notice: Subject to any disclaimer, the term of this patent is extended or adjusted under 35 U.S.C. 154(b) by 0 days.

(21) Appl. No.: 10/682,006

(22) Filed: Oct. 9, 2003

(65) Prior Publication Data

US 2004/0079338 A1 Apr. 29, 2004

(30) Foreign Application Priority Data

Oct. 24, 2002 (JP) ..... 2002-309516

(51) Int. Cl.[7] ..... F02M 55/02
(52) U.S. Cl. ..... 123/456; 123/468
(58) Field of Search ..... 123/456, 468, 123/469, 467

(56) References Cited

U.S. PATENT DOCUMENTS 5,095,876 A * 3/1992 Yonekawa et al. ..... 123/468
5,311,850 A * 5/1994 Martin ..... 123/456
5,359,976 A * 11/1994 Nakashima et al. ..... 123/516
5,592,968 A * 1/1997 Nakashima et al. .... 137/561 A
5,752,486 A * 5/1998 Nakashima et al. ..... 123/467
6,401,691 B1 * 6/2002 Kawano et al. ..... 123/456
6,494,182 B1 * 12/2002 Djordjevic ..... 123/456

* cited by examiner

*Primary Examiner*—Thomas Moulis
(74) *Attorney, Agent, or Firm*—Ladas & Parry

(57) ABSTRACT

A fuel distributor for distributing fuel supplied by pressure through a fuel feed pipe by a fuel feed system to a plurality of fuel injectors is capable of effectively reducing the amplitude of a pulsative pressure wave and the sound levels of transmitted sounds. The fuel distributor includes a fuel rail, and a fuel distribution line including a pipe fitting connected to the fuel feed pipe, and first and second branch pipes each having one end connected to the pipe fitting and the other end connected to the fuel rail. The first and the second branch pipes are connected respectively to different parts of the fuel rail.

6 Claims, 3 Drawing Sheets

FUEL DISTRIBUTOR

BACKGROUND OF THE INVENTION

1. Field of the Invention

The present invention relates to a fuel distributor included in a fuel feed system for automobiles.

2. Description of the Related Art

A fuel feed system for feeding fuel to an automotive engine pumps fuel through a fuel feed line to a fuel rail. The fuel is distributed to fuel injectors attached to the fuel rail to inject fuel into an intake manifold connected to the engine.

Referring to FIG. 5, a conventional fuel distributor has a fuel rail 10 formed by joining an upper case 10*a* and a lower case 10*b*, which are formed by pressing a plate. The joining parts of the upper case 10*a* and the lower case 10*b* are bonded together by brazing. Fuel injector cups 17 are attached to the lower wall of the lower case 10*b*. The terminal end of a fuel feed pipe 12 is connected to a middle part of the upper wall of the upper case 10*a*. If there is a spatial restriction on laying the fuel feed pipe 12, the terminal end of the fuel feed pipe 12 is connected to a side wall of the upper case 10*a* as shown in FIG. 6.

Problems with the fuel distributor include the pulsation of fuel due to the fuel-injecting operation of the fuel injectors, and the transmission of noise by the fuel rail. It has been a usual practice to attach an outer damper to the fuel rail to suppress vibrations and noise transmission. It is a recent technical trend to provide the fuel rail with an internal damping means or to design the three-dimensional shape of the fuel rail so that the fuel rail may absorb vibrations and noise.

To provide the fuel rail with a pulsation suppressing function and a noise transmission suppressing function, it is advantageous to the fuel rail that the fuel rail is designed in a shape deformable according to pressure variation to absorb vibrations and noise easily. However, it is delicate and difficult to design the fuel rail so that the fuel rail meets both a requirement for rigidity and a requirement for vibration/noise absorption. Fuel rails of some fuel-distributing units are satisfactory in effect on pulsation suppression and unsatisfactory in effect on noise transmission suppression and vice versa. Thus, it is difficult to provide a fuel rail capable of coping with both pulsation suppression and noise transmission suppression at the present.

SUMMARY OF THE INVENTION

Accordingly, it is an object of the present invention to provide a fuel distributor capable of solving problems in the prior art and of effectively suppressing both pulsation and noise transmission.

According to the present invention, a fuel distributor for distributing fuel supplied by pressure through a fuel feed pipe by a fuel feed system to a plurality of fuel injectors comprises a fuel rail; and a fuel distribution line having one end connected to the fuel feed pipe, and the other end divided into a plurality of branches respectively connected to different parts of the fuel rail.

In the fuel distributor according to the present invention, the fuel distribution line may be arranged in the vicinity of the fuel rail.

In the fuel distributor according to the present invention, the fuel distribution line may include a pipe fitting connected to the fuel feed pipe, and a plurality of branch pipes having ends connected to the pipe fitting, and other ends respectively connected to the different parts of the fuel rail.

In the fuel distributor according to the present invention, the fuel rail may be formed in a shape resembling an elongate box longitudinally extending along a row of the fuel injectors, and may have a wide wall opposite a wall on which the fuel injectors are arranged, and a narrow wall substantially perpendicular to the wide wall, at least one of the plurality of branch pipes may be connected to the wide wall, and at least one of the plurality of the branch pipes may be connected to the narrow wall.

The branch pipes may be a first branch pipe connected to the narrow wall, and a second branch pipe connected to the wide wall, the pipe fitting may be disposed near the narrow wall, a principal part of the second branch pipe may extend parallel to the wide wall, and the first branch pipe may be perpendicular to the narrow wall.

In the fuel distributor according to the present invention, the second branch pipe may be connected to a middle part of the wide wall, and the first branch pipe may be shorter than the second branch pipe.

From the viewpoint of the propagation of vibrations, the fuel-distributor line having the plurality of branch pipes of the fuel distributor according to the present invention serves as a junction where waves propagated through the branch pipes are superposed randomly.

Consequently, the amplitudes of the waves are averaged and reduced vibrations are transmitted to the fuel feed pipe. For example, the waves propagated through the first and the second branch pipe attenuate each other to produce a wave having a small amplitude. Consequently, both the transmission of pulsations to the fuel feed pipe, and noise generation by the fuel rail can be suppressed.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Figure 1:
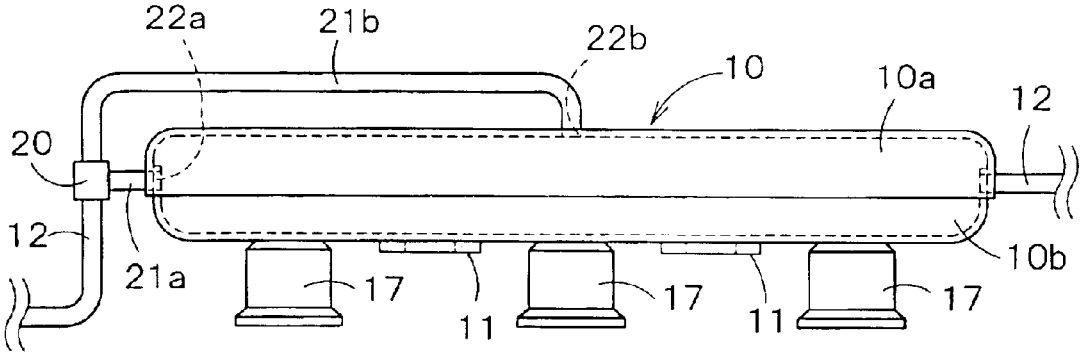
FIG. 1 is a front elevation of a fuel distributor in a preferred embodiment according to the present invention.

Referring to FIG. 1, a fuel distributor in a preferred embodiment according to the present invention has a fuel rail 10 connected to a fuel feed pipe 12. The fuel rail 10 and the fuel feed pipe 12 are included in a returnless fuel feed system. Fuel is pumped from a fuel tank, not shown, through the fuel feed pipe 12 into the fuel rail 10. When the present invention is applied to a V-6 engine, two fuel rails similar to the fuel rail 10 shown in FIG. 1 are disposed parallel to each other.

The fuel rail 10 of the fuel distributor has the shape of an elongate box. The fuel rail 10 is formed by joining together an upper case 10*a* and a lower case 10*b* by brazing. Two mounting brackets 11 are attached to the lower case 10*b*. The fuel rail 10 may be a monolithic structure formed by working a metal pipe. The lower case 10*b* has a bottom wall provided with three fuel feed openings. Injector cups 17 for holding fuel injectors are attached to the bottom wall of the lower case 10*b* so as to be connected to the fuel feed openings. The injector cups 17 are arranged longitudinally in a row on the center axis of the lower case 10*b* at predetermined intervals. Injectors are mounted on the lower case 10*b* by pressing the injectors in the injector cups 17. A three-way pipe fitting (T-type pipe fitting) 20 connected to the fuel feed pipe 12 is disposed on the upstream side of the fuel rail 10. A first branch pipe 21*a* and a second branch pipe 21*b* are connected to the three-way pipe fitting 20. When the present invention is applied to a V-6 engine, two fuel rails 10 similar to the fuel rail 10 shown in FIG. 1 are installed, and a first branch pipe 21*a* and a second branch pipe 21*b* connected to a three-way pipe fitting 20 is combined with each of the two fuel rail 10.

A first opening 22*a* is formed in an end wall (narrow wall) of the fuel rail 10 on the upstream side, and the first branch pipe 21*a* is connected to the first opening 22*a*. A second opening 22*b* is formed substantially in a middle part of the top wall (wide wall) having the largest area among the walls, i.e., the top wall, the bottom wall, the opposite end walls and the right and the left wall, of the fuel rail 10, and the second branch pipe 21*b* is connected to the second opening 22*b*. Thus, the first branch pipe 21*a* and the second branch pipe 21*b* open in the different walls, respectively, of the fuel rail 10.

The operation and effect of the fuel distributor in the preferred embodiment will be described. While the engine is in operation, fuel pumped by a fuel pump flows through the fuel feed pipe 12, and the first branch pipe 21*a* and the second branch pipe 21*b* connected to the three-way pipe fitting 20 into the fuel rail 10. The fuel rail 10 distributes fuel to the fuel injectors. The fuel injectors operate sequentially and repeat a fuel-injecting operation periodically. The pressure of fuel in the fuel rail 10 decreases when the injector opens to inject fuel, and increases sharply when the fuel injector closes. Since each of the fuel injectors repeats the fuel-injecting operation periodically, the pressure in the fuel rail varies to produce an oscillatory phenomenon. This oscillatory phenomenon is pressure pulsation from the viewpoint of pressure, and is noise generation from the viewpoint of sound. Consequently, the fuel rail 10 generates noise.

In this fuel distributor in the preferred embodiment, the fuel feed pipe 12 is connected to the three-way pipe fitting 20, and the first branch pipe 21*a* and the second branch pipe 21*b* extend from the three-way pipe fitting 20. Therefore, the three-way pipe fitting 20 is a branching point in the fuel feed line from the viewpoint of the flow of fuel, and is a junction point where waves propagating through the first branch pipe 21*a* and the second branch pipe 21*b* are superposed from the viewpoint of the propagation of vibrations. The waves propagated through the first branch pipe 21*a* and the second branch pipe 21*b* attenuate each other to produce a wave having a small amplitude. Consequently, both the transmission of pulsations from the fuel rail 10 to the fuel feed pipe 12, and noise generation by the fuel rail 10 can be suppressed.

Formation of the second opening 22*b* in the top wall having a large area of the fuel rail 10, the extension of the second branch pipe 21*b* over the top wall of the fuel rail 10 makes the second opening 22*b* function as an orifice that attenuates pulsative waves. Since the orifice ratio A/a, where A is the area of the top wall of the fuel rail 10, and a is the area of the second opening 22*b*, is large, the second opening 22*b* has a high orifice effect. Thus, the propagation of pulsative waves through the second branch pipe 21*b* is suppressed, and pulsative waves are attenuated at the junction.

Figure 2:
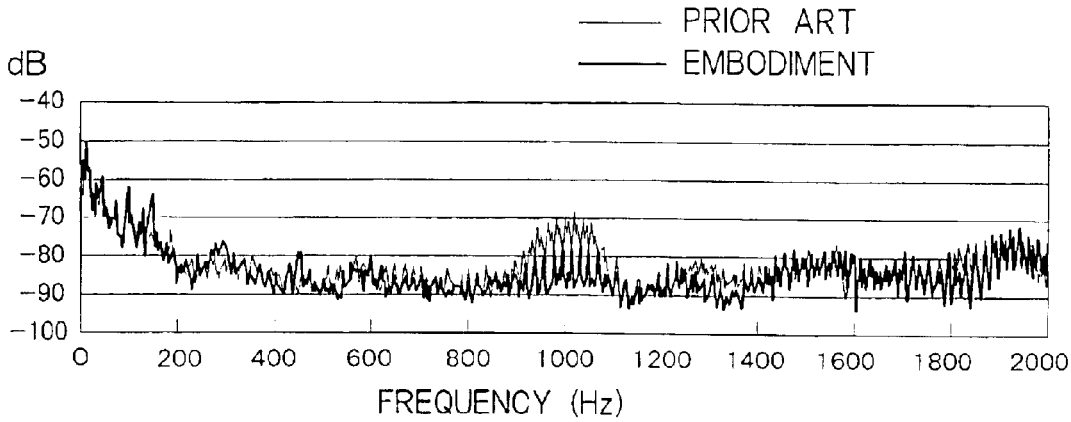
FIG. 2 is a graph showing measured sound levels of sounds generated by the fuel distributor shown in FIG. 1.

FIG. 2 shows measured sound levels of transmitted sounds of different frequencies transmitted by a conventional fuel distributor and the fuel distributor embodying the present invention mounted on a V-6 engine mounted on a vehicle during idling at an engine speed of 750 rpm. In FIG. 2, a thick line and a thin line indicate measured values for the fuel distributor of the present invention and the conventional fuel distributor, respectively. The respective fuel rails of the fuel distributor of the present invention and the conventional fuel distributor are the same in material and construction.

As obvious from FIG. 2, the sound levels of transmitted sounds having frequencies in the range of 800 to 1200 Hz transmitted by the fuel distributor of the present invention are low. It is known that the frequencies of audible sounds are in the range of 20 to 2000 Hz. The automobile generates various noises.

Different noises have frequencies in different frequency ranges. Since the frequency range of sounds generated by the repetition of the fuel-injecting operation of the fuel injector coincides with the frequency range of 800 to 1200 Hz. Thus, it is known that the use of the branch pipes has a transmitted sound reducing effect.

Figure 3A:
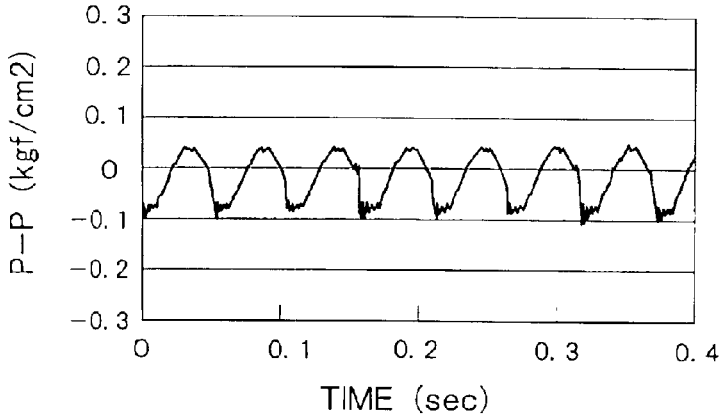
FIGS. 3(*a*) and 3(*b*) are graphs showing measured pulsative pressure waves generated by the fuel distributor shown in FIG. 1.
Figure 3B:
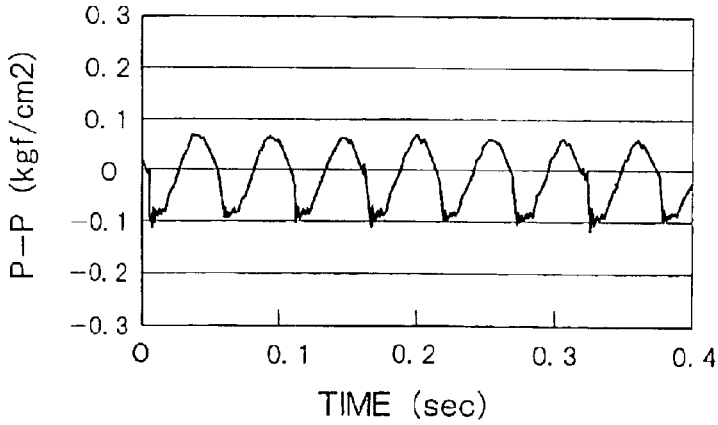

FIGS. 3(*a*) and 3(*b*) show measured pulsative pressure waves generated by the fuel distributor of the present invention and the conventional fuel distributor, respectively, measured under the same conditions as the measurement of the sound levels of the transmitted sounds. It is known from the comparative observation of the pulsative pressure waves shown in FIGS. 3(*a*) and 3(*b*) that the use of the branch pipes reduces the amplitude of the pulsative pressure wave by about 10% to about 20%.

Figure 4:
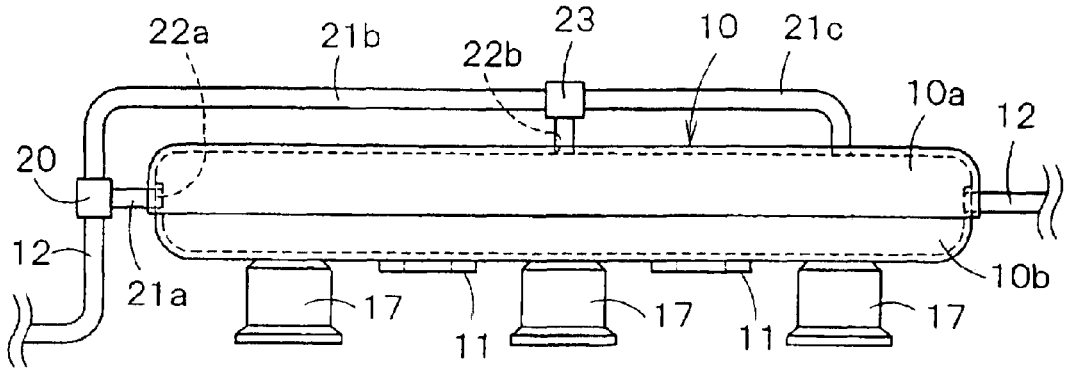
FIG. 4 is a front elevation of a fuel distributor in a modification of the fuel distributor shown in FIG. 1.
Figure 5:
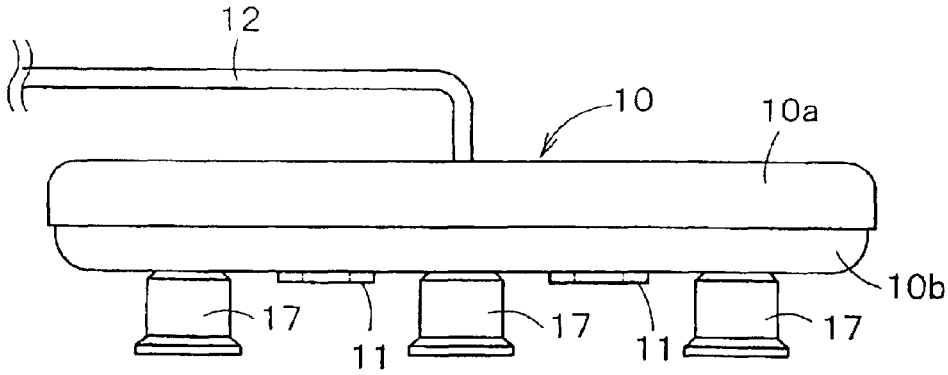
FIG. 5 (PRIOR ART)
FIG. 5 is a front elevation of a conventional fuel distributor.
Figure 6:
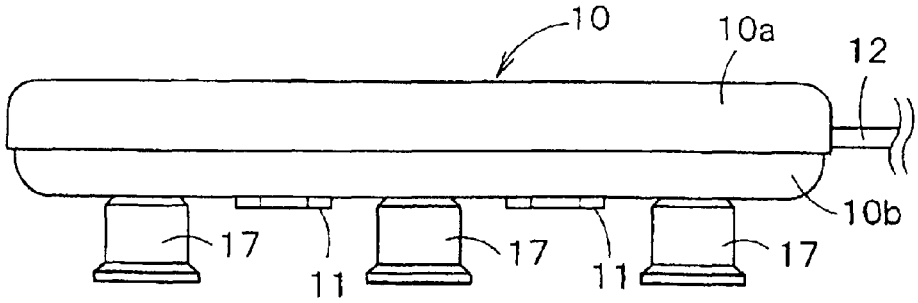
FIG. 6 (PRIOR ART)
FIG. 6 is a front elevation of another conventional fuel-distributing unit.

FIG. 4 shows a fuel distributor in a modification of the fuel distributor shown in FIG. 1. The fuel distributor shown in FIG. 4 is provided with three branch pipes for three fuel injectors. More concretely, the fuel distributor has a first branch pipe 21*a* having one end connected to an end wall of a fuel rail 10, and the other end connected to a first three-way pipe fitting 20 connected to a fuel feed pipe 12; a second branch pipe 21*b* having one end connected to the first three-way pipe fitting 20, and the other end connected to a second three-way pipe fitting 23 and connected by a pipe 22*b* to a substantially middle part of the top wall of the fuel rail 10; a third branch pipe 21*c* having one end connected to the second three-way pipe fitting 23, and the other end connected to a part of the top wall of the fuel rail 10 near the other end of the fuel rail 10.

As apparent from the foregoing description, according to the present invention, the fuel distributor has the plurality of branch pipes branched from the fuel feed pipe, connected respectively to different parts of the fuel rail, and capable of effectively reducing the amplitude of the pulsative pressure wave and the sound levels of transmitted sounds. As illustrated in FIGS. 1 and 4, each of the branch pipes has the same diameter as the fuel feed pipe 12.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A fuel distributor for distributing fuel supplied by pressure through a fuel feed pipe by a fuel feed system to a plurality of fuel injectors, said fuel distributor comprising:

a fuel rail; and a fuel distribution line having one end connected to the fuel feed pipe, and the other end divided into a plurality of branches respectively connected to different parts of the fuel rail, wherein each of the plurality of branches has the same diameter as the fuel feed pipe.

2. The fuel distributor according to claim 1, wherein the fuel distribution line is arranged in the vicinity of the fuel rail.

3. The fuel distributor according to claim 1, wherein the fuel distribution line includes: a pipe fitting connected to the fuel feed pipe, and a plurality of branch pipes having ends connected to the pipe fitting, and other ends respectively connected to the different parts of the fuel rail.

4. The fuel distributor according to claim 3, wherein the fuel rail is formed in a shape resembling an elongate box longitudinally extending along a row of the fuel injectors, and has a wide wall opposite a wall on which the fuel injectors are arranged, and a narrow wall substantially perpendicular to the wide wall, at least one of the plurality of branch pipes is connected to the wide wall, and at least one of the plurality of branch pipes is connected to the narrow wall.

5. The fuel distributor according to claim 4, wherein the branch pipes are a first branch pipe connected to the narrow wall, and a second branch pipe connected to the wide wall, the pipe fitting is disposed near the narrow wall, a principal part of the second branch pipe extends parallel to the wide wall, and the first branch pipe is perpendicular to the narrow wall.

6. The fuel distributor according to claim 5, wherein the second branch pipe is connected to a middle part of the wide wall, and the first branch pipe is shorter than the second branch pipe.

* * * * *